United States Patent [19]

Hogenkamp et al.

[11] Patent Number: 4,724,997

[45] Date of Patent: Feb. 16, 1988

[54] METHOD OF MANUFACTURING PACKAGING FOR BAR-SHAPED ARTICLES, ESPECIALLY CHOCOLATE BARS, AND BAR PACKAGING MANUFACTURED THEREBY

[75] Inventors: Wilhelm Hogenkamp, Hanover; Gerd Wostbrock, Garbsen, both of Fed. Rep. of Germany

[73] Assignee: Otto Hänsel GmbH, Hanover, Fed. Rep. of Germany

[21] Appl. No.: 882,881

[22] PCT Filed: Dec. 10, 1985

[86] PCT No.: PCT/EP85/00688

§ 371 Date: Jun. 17, 1986

§ 102(e) Date: Jun. 17, 1986

[87] PCT Pub. No.: WO86/03473

PCT Pub. Date: Jun. 19, 1986

[30] Foreign Application Priority Data

Dec. 10, 1984 [DE] Fed. Rep. of Germany ..... 3444950

[51] Int. Cl.[4] ..... B65D 75/08; B65D 75/20; B65D 85/60

[52] U.S. Cl. ..... 229/87 F; 206/491; 53/462

[58] Field of Search ..... 53/207, 208, 230, 461, 53/462, 463; 206/491, 492; 229/87 F, 87 G, 87 J; 493/251, 252

[56] References Cited

U.S. PATENT DOCUMENTS

| | | | |
|---|---|---|---|
| 1,126,823 | 2/1915 | Milmoe | 53/461 |
| 2,301,997 | 11/1942 | Basilone et al. | 229/87 G |
| 2,696,702 | 12/1954 | Martin | 53/379 |
| 2,834,531 | 5/1958 | Struble | 206/492 |
| 4,244,511 | 1/1981 | Coleman | 206/492 |

FOREIGN PATENT DOCUMENTS 469572 7/1937 United Kingdom .

*Primary Examiner*—Robert L. Spruill
*Assistant Examiner*—Donald R. Studebaker
*Attorney, Agent, or Firm*—Max Fogiel

[57] ABSTRACT

The invention concerns a method of manufacturing packaging for bar-shaped articles, especially chocolate bars, whereby a blank of wrapping material that is to be wrapped around both longitudinal sides of the bar is cut out in accordance with the invention at one longitudinal side of the bar at both ends of the bar to match its length and wrapped around the bar along with the remaining part of the blank and welded or glued along one lateral edge of the bar to create a tube of wrapping material, subsequent to which the tube of wrapping material extending beyond the ends of the bar is closed in a face fold at both ends, wrapped over the wrapped face folds (6) leaving white-line matter (3) over one complete side of the bar, and secured to the wrapper by gluing or welding.

10 Claims, 10 Drawing Figures

METHOD OF MANUFACTURING PACKAGING FOR BAR-SHAPED ARTICLES, ESPECIALLY CHOCOLATE BARS, AND BAR PACKAGING MANUFACTURED THEREBY

The invention concerns a method of manufacturing packaging for bar-shaped articles, especially chocolate bars, and the bar packaging manufactured thereby. Conventional 100-gram chocolate bars are presently manufactured either on a one-station or on a two-station machine. In the first case the packaging consists of an inner wrapping of aluminum foil for example and of an outer wrapping of paper for example. Both of these materials are wrapped around the bar being packaged in an envelope fold or cube fold in one operation. It is impossible to obtain what is called a sealing fold in this method. To obtain a tight package a two-station machine is necessary, allowing the inner wrapping of aluminum foil to be folded around the bar and if necessary sealed to obtain the tight package. The outer (paper) wrapping is then wrapped around the bar wrapped in the aluminum foil. It can be a complete wrapping or only a slipover. The drawback to this method is the high cost of building the machine as dictated by the two separate material feeds for a two-station machine or by the separate wrapping if carried out on two different machines.

The object of the present invention is to eliminate this drawback and to allow a sealing fold to be obtained with only one wrapping material, with the design of the fold corresponding to contemporary bar-packaging practices. Labeling conditions make it necessary to design the white line in such a way that the bottom of the bar will be completely covered. The packaging should also be designed to ensure that it is destroyed when the bar is removed and cannot be employed to rewrap the bar.

This object is attained in accordance with the invention in that a blank of wrapping material that is to be wrapped around both longitudinal sides of the bar is cut out at one longitudinal side of the bar at both ends of the bar to match its length and wrapped around the bar along with the remaining part of the blank and welded or glued along one lateral edge of the bar to create a tube of wrapping material, subsequent to which the tube of wrapping material extending beyond the ends of the bar is closed in a face fold at both ends, wrapped over the wrapped face folds leaving white-line matter over one complete side of the bar, and secured to the wrapper by gluing or welding.

The blank of wrapping material employed in carrying out this method of manufacturing a packaging for bar-shaped articles is cut out at one side at both ends along both longitudinal sides of the bar in accordance with the length of the particular bar to create a section of the blank that is wrapped around the bar and that, when it is folded around, leaves what is called the face fold free.

Figure 1:
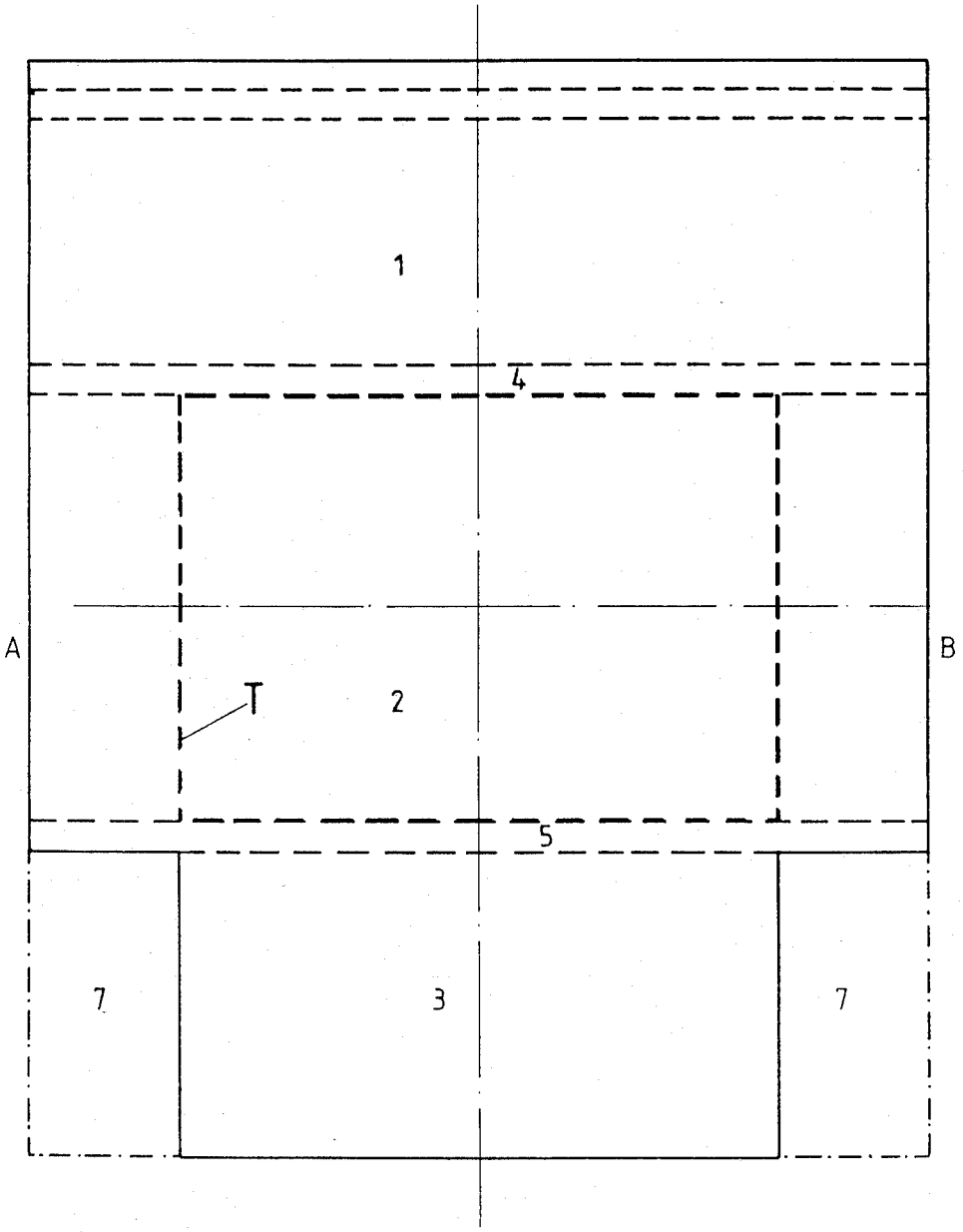

This section of the blank is wrapped around the bar (T) and welded along its longitudinal side. Furthermore, the section of the blank that constitutes the white line on the package is positioned against the bottom of the bar and a face infold created out of the sections of wrapping material that extend beyond the end of the bar. The face infold is then folded around the base of the bar and if necessary glued or welded. dr The concept behind the invention allows a very wide range of embodiments. One embodiment is illustrated in the figures, wherein FIG. 1 is a top view of the blank of wrapping material employed and FIGS. 2 through 10 illustrate a chocolate bar during the various stages of packaging.

A blank of packaging material consists of sections 1, 2, and 3, which are wrapped around a bar T.

Figure 2:
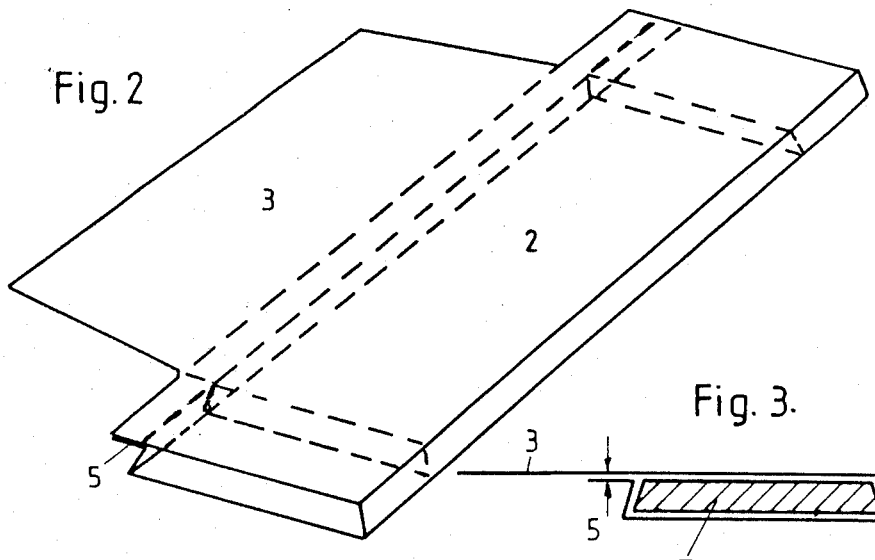
Figure 3:
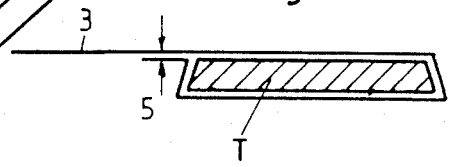
Figure 4:
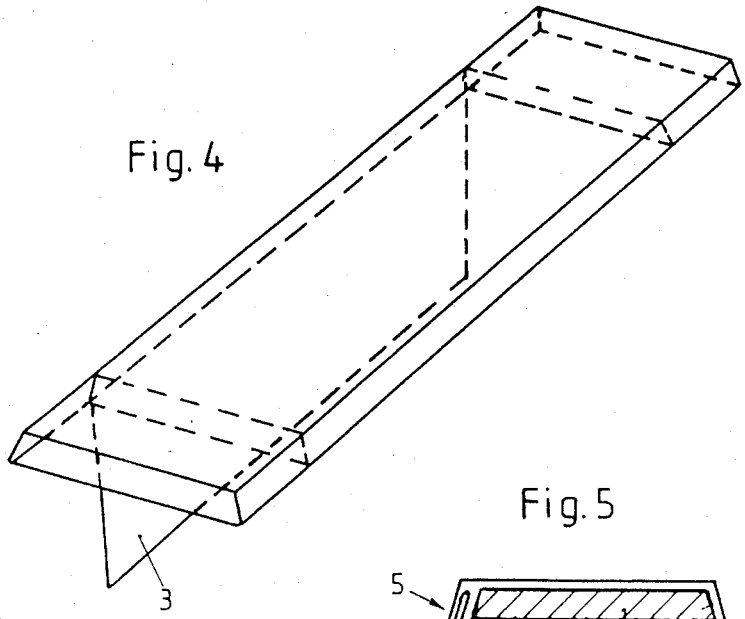
Figure 5:
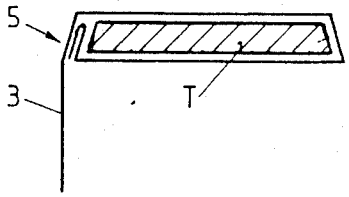

Sections 1, 2, and 3 are wrapped around bar T as illustrated in FIG. 2. A welded seam 5 is created, subsequent to appropriate in-folding, along the upper longitudinal edge of the bar.

Figure 6:
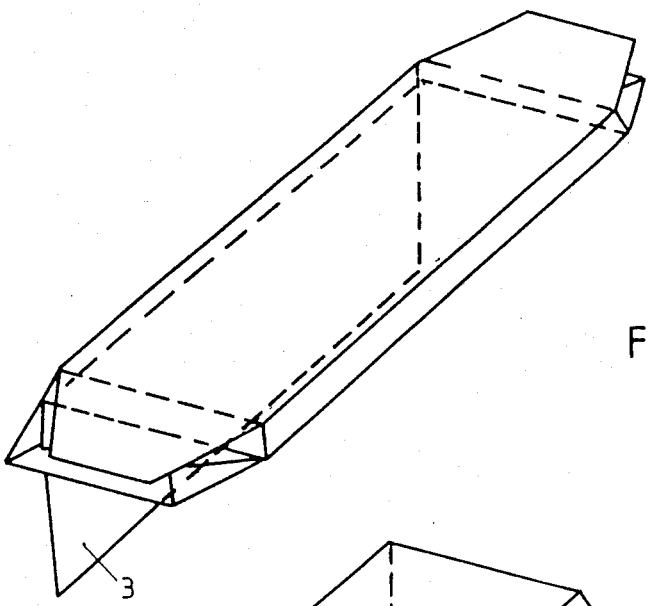
Figure 7:
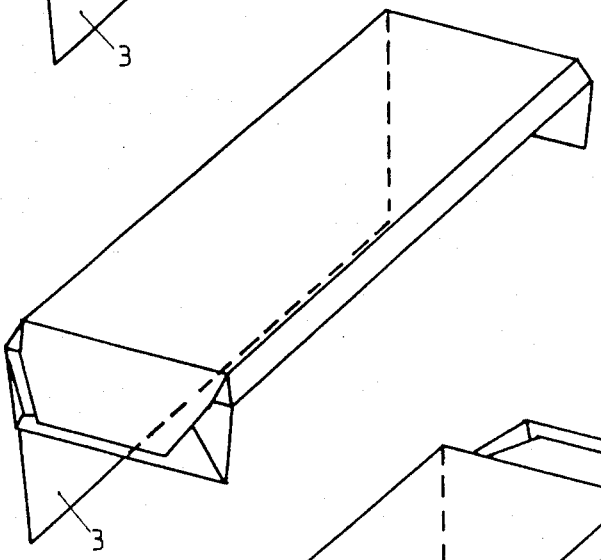
Figure 8:
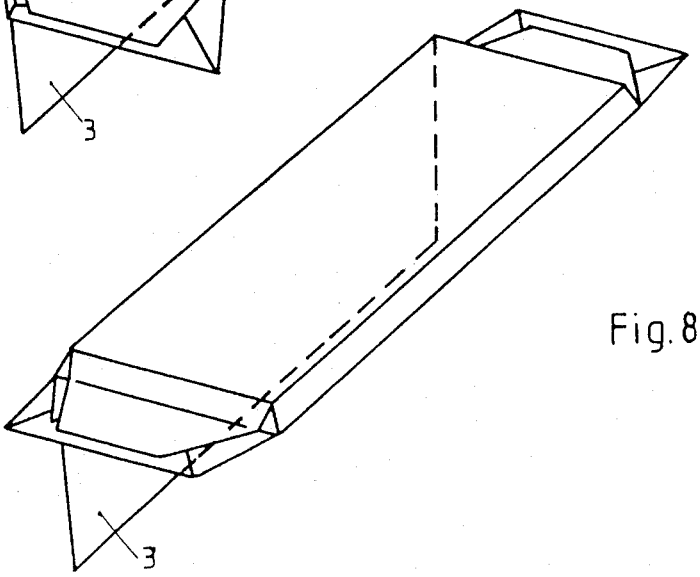
Figure 9:
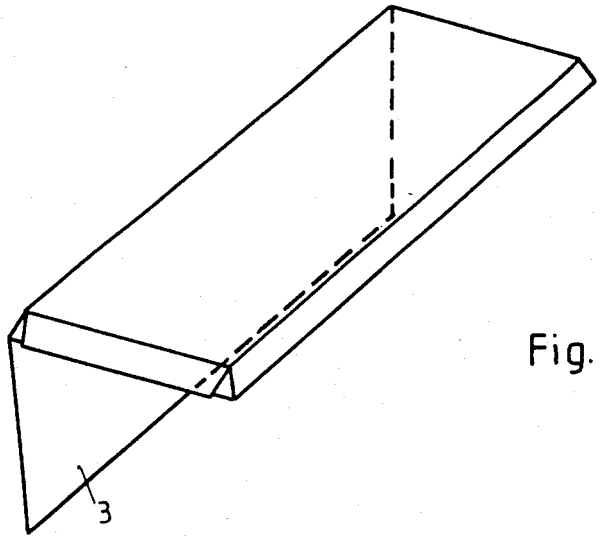
Figure 10:
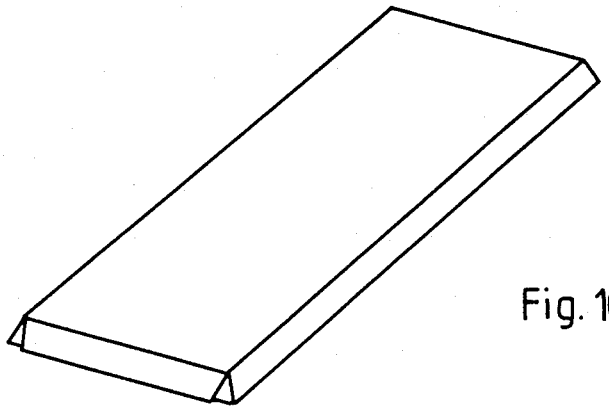

Blank section 3 is cut out at the area 7 indicated by the dot-and-dash lines at the ends A and B of the bar. Once the blank has been folded around bar T, the previously established tube of wrapping material will project beyond ends A and B. The tube is then wrapped in a face fold as illustrated in FIG. 6 through 8. The face fold as illustrated in FIG. 6 is bent down as illustrated in FIG. 7 and folded against the bottom of the bar. It ca nbe glued cold or hot to the rest of the wrapper at that point. Finally, as illustrated in FIGS. 9 and 10, blank section 3 is positioned flat against the base of the bar and secured to the rest of the wrapper by gluing or welding, with the face infold completely covered by wrapping-material blank 3 at both ends of the bar.

We claim:

1. Packaging for bar-shaped articles, particularly chocolate bars, comprising: a one-piece blank of wrapping material having cut-out areas to form a covering flap, said blank having a substantially central area for contacting one face of a bar-shaped article, said area having a longtiudinal axis, said central area extending beyond the ends of said bar-shaped article when said one face thereof contacts said central area, said blank having folds along opposite longitudinal edges of said bar-shaped article when said blank is wrapped about said article; said blank having a first end area adjoining one of said longitudinal edges; said central area having a longitudinal axis parallel to the longitudinal axis of said article; said first end area having a longitudinal axis parallel to the longitudinal axis of said article, said first end area having longitudinal edges substantially equal in length to the longitudinal edge of said central area adjoining said first end area; a second end area on said blank adjoining said central area at the other longitudinal edge along said article and having said cut-out areas to form said covering flap with a length substantially equal to the length of said article; said first end area having a strip-shaped area element for sealing against said covering flap at a location where said second end area and thereby said flap adjoin said central area after said blank is wrapped about said article; said flap having an outside edge for sealing against said central area after wrapping said flap about said article with said strip-shaped area element against an inside surface of said flap.

2. Packaging as defined in claim 1, wherein said blank has a substantially rectangular shape.

3. Packaging as defined in claim 1, wherein said cut-out areas have a substantially rectangular shape.

4. Packaging as defined in claim 1, wherein said first end area has a further strip-shaped area element adjoining said first-mentioned strip-shaped area element and lying against said other longitudinal edge along said article.

5. Packaging for bar-shaped articles, particularly chocolate bars, comprising: a one-piece blank of wrapping material having cut-out areas to form a covering flap, said blank having a substantially central area for contacting one face of a bar-shaped article, said area having a longitudinal axis, said central area extending beyond the ends of said bar-shaped article when said one face thereof contacts said central area, said blank having folds along opposite longitudinal edges of said bar-shaped article when said blank is wrapped about said article; said blank having a first end area adjoining one of said longitudinal edges; said central area having a longitudinal axis parallel to the longitudinal axis of said article; said first end area having a longitudinal axis parallel to the longitudinal axis of said article, said first end area having longitudinal edges substantially equal in length to the longitudinal edge of said central area adjoining said first end area; a second end area on said blank adjoining said central area at the other longitudinal edge along said article and having said cut-out areas to form said covering flap; said first end area having a strip-shaped area element for sealing against said covering flap at a location where said second end area and thereby said flap adjoin said central area after said blank is wrapped about said article.

6. Packaging as defined in claim 5, wherein said flap has an outside edge for sealing against said central area after wrapping said flap about said article with said strip-shaped area element against an inside surface of said flap.

7. Packaging as defined in claim 5, wherein said blank has a substantially rectangular shape.

8. Packaging as defined in claim 5, wherein said cut-out areas have a substantially rectangular shape.

9. Packaging as defined in claim 5, wherein said first end area has a further strip-shaped area element adjoining said first-mentioned strip-shaped area element and lying against the other longitudinal edge of said article.

10. Packaging for bar-shaped articles, particularly chocolate bars, comprising: a one-piece blank of wrapping material having cut-out areas to form a covering flap, said blank having a substantially central area for contacting one face of a bar-shaped article, said area having a longitudinal axis, said central area extending beyond the ends of said bar-shaped article when said one face thereof contacts said central area, said blank having folds along opposite longitudinal edges of said bar-shaped article when said blank is wrapped about said article; said blank having a first end area adjoining one of said longitudinal edges; said central area having a longitudinal axis parallel to the longitudinal axis of said article; said first end area having a longitudinal axis parallel to the longitudinal axis of said article, said first end area having longitudinal edges substantially equal in length to the longitudinal edge of said central area adjoining said first end area; a second end area on said blank adjoining said central area at the other longitudinal edge along said article and having said cut-out areas to form said covering flap with a length substantially equal to the length of said article.

* * * * *